US011516887B2

(12) United States Patent
Yamamoto

(10) Patent No.: US 11,516,887 B2
(45) Date of Patent: Nov. 29, 2022

(54) HEAT-GENERATED DEVICE AND METHOD FOR PRODUCING SAME

(71) Applicant: INTERNATIONAL ENGINEERED ENVIRONMENTAL SOLUTIONS INC., Fukuoka (JP)

(72) Inventor: Hiroaki Yamamoto, Fukuoka (JP)

(73) Assignee: INTERNATIONAL ENGINEERED ENVIRONMENTAL SOLUTIONS INC., Fukuoka (JP)

( * ) Notice: Subject to any disclaimer, the term of this patent is extended or adjusted under 35 U.S.C. 154(b) by 855 days.

(21) Appl. No.: 16/314,051

(22) PCT Filed: Jul. 5, 2017

(86) PCT No.: PCT/JP2017/024699
§ 371 (c)(1),
(2) Date: Dec. 28, 2018

(87) PCT Pub. No.: WO2018/008695
PCT Pub. Date: Jan. 11, 2018

(65) Prior Publication Data

US 2019/0208578 A1 Jul. 4, 2019

(30) Foreign Application Priority Data

Jul. 5, 2016 (JP) ..... 2016-133020

(51) Int. Cl.
*H05B 3/14* (2006.01)
*H05B 3/44* (2006.01)
(Continued)

(52) U.S. Cl.
CPC ..... *H05B 3/145* (2013.01); *H05B 3/03* (2013.01); *H05B 3/14* (2013.01); *H05B 3/148* (2013.01);
(Continued)

(58) Field of Classification Search
None
See application file for complete search history.

(56) References Cited

U.S. PATENT DOCUMENTS 3,037,266 A * 6/1962 Pfister ..... H01C 7/001 264/105
3,676,925 A * 7/1972 Sato ..... H01C 7/001 29/613
(Continued)

FOREIGN PATENT DOCUMENTS

JP 62-172684 A 7/1987
JP 1-186782 A 7/1989
(Continued)

OTHER PUBLICATIONS

Office Action EP 17824298.8, 3 pages, Applicant: International Engineered Environmental Solutions, Inc., dated Dec. 17, 2019.
(Continued)

*Primary Examiner* — Thor S Campbell
(74) *Attorney, Agent, or Firm* — Fay Sharpe LLP

(57) ABSTRACT

Problem to be Solved
To provide a heat-generating device capable of efficiently maintaining heat generation for a long time at a low cost while saving power.
Solution
The heat-generating device includes: a hollow vessel having an electrically insulated inner part; a pair of counter electrodes housed inside the vessel, and separated from and opposing each other; and a heat-generating body housed between the counter electrodes inside the vessel, and composed of silicon powder and carbon powder in a mixed state.

23 Claims, 9 Drawing Sheets

(51) Int. Cl.
*H05B 3/03* (2006.01)
*H05B 3/60* (2006.01)

(52) U.S. Cl.
CPC ..... *H05B 3/44* (2013.01); *H05B 3/60* (2013.01); *H05B 2203/017* (2013.01)

(56) References Cited

U.S. PATENT DOCUMENTS

| | | | | |
|---|---|---|---|---|
| 4,550,301 | A * | 10/1985 | McTavish | H01C 7/027 338/276 |
| 4,910,389 | A * | 3/1990 | Sherman | H01C 7/027 219/504 |
| 5,388,177 | A * | 2/1995 | Ono | A61L 9/03 392/386 |
| 5,756,215 | A * | 5/1998 | Sawamura | C04B 35/117 219/541 |
| 9,345,069 | B2 * | 5/2016 | Colburn | H05B 3/145 |
| 10,978,420 | B2 * | 4/2021 | Hagiwara | H01L 21/52 |
| 2001/0016115 | A1 * | 8/2001 | Hirata | H05B 3/30 392/435 |
| 2002/0040900 | A1 * | 4/2002 | Arx | B29C 51/02 219/544 |
| 2003/0129487 | A1 * | 7/2003 | Inoue | H01M 50/1243 429/129 |
| 2008/0251510 | A1 * | 10/2008 | Park | B82Y 30/00 219/528 |
| 2012/0077020 | A1 * | 3/2012 | Muramatsu | B82Y 40/00 428/319.1 |
| 2013/0160703 | A1 * | 6/2013 | Okada | C04B 35/536 117/208 |
| 2014/0038011 | A1 * | 2/2014 | Fukunaga | H01M 10/486 429/62 |
| 2017/0204532 | A1 * | 7/2017 | Land | C04B 35/80 |
| 2018/0027613 | A1 * | 1/2018 | Tabuchi | C23C 10/60 219/553 |

FOREIGN PATENT DOCUMENTS

| | | | |
|---|---|---|---|
| JP | 2-30085 | A | 1/1990 |
| JP | 2002-89865 | A | 3/2002 |
| JP | 2003-162170 | A | 6/2003 |
| WO | WO 2015/027941 | A1 | 3/2015 |

OTHER PUBLICATIONS

Office Action JP2018-526420 with English Translation, 9 Pages, date of drafting Oct. 1, 2019, Patent Examiner: Tsuchiya, Masashi 3739 3L00; Representative/Applicant: Hirai, Yasuo.

International Search Report with English Explanation, 4 pages, dated Oct. 3, 2017, ISA Japan Patent Office, Tokyo 100-8915, Japan.

* cited by examiner

HEAT-GENERATED DEVICE AND METHOD FOR PRODUCING SAME

TECHNICAL FIELD

The present invention relates to a heat-generating device that generates heat by application of a voltage, and particularly to a heat-generating device that efficiently keeps heat generation for a long time at a low cost while saving power, and a method for producing the same.

BACKGROUND ART

Heat-generating devices from an electric pot to various heaters such as an oil heater, a ceramic heater, and the like are widely utilized, and have become important goods indispensable to our lives.

On the other hand, the heat-generating device requires, for example, hundreds of watts to 1 kilowatt of electricity as a heat source in order to boil water like an electric pot, and further requires continuous power in order to maintain a heat retention state. For example, like an oil heater, a housing is large, and therefore it is not easy to handle the heater. Additionally, some oil heaters have high power consumption, and have a disadvantage of being not easily often used.

From these reasons, a heat-generating device capable of increasing a temperature for a short time while saving power is eagerly desired.

Examples of a conventional heat-generating device include a heating device including: a plurality of glass tubes; resistors provided around the glass tube, the resistor being configured to generate heat by allowing electricity to flow in the resistors; and a steam generation part that heats water by utilization of the heat of the resistors to generate steam in order to attain introduction into the glass tubes (refer to Patent Literature 1).

The examples of the conventional heat-generating devices include a filter for fluid temperature rise that is a filter for a purpose of increasing the temperature of fluid, contains silicon and silicon carbide, and is used by being heated by microwaves (refer to Patent Literature 2).

CITATION LIST

Patent Literature

Patent Literature 1: Japanese Patent Laid-Open No. 2015-222648

Patent Literature 1: Japanese Patent Laid-Open No. 2011-236070

SUMMARY OF INVENTION

Technical Problem

In the conventional heat-generating devices, there is a device that heats water by utilizing heat of the resistors that generate heat by allowing electricity to flow, and generate steam, like the above Patent Literature 1. However, the heat of the resistors is once converted into steam, and therefore a loss of heat energy is generated with this conversion, an amount of heat energy capable of being actually utilized to a total of the generated energy is low, and efficiency remains low.

In the conventional heat-generating devices, there is a filter used by being heated by microwaves or the like, like the above Patent Literature 2. However, high energy is required in order to perform heating as a presupposition, and the efficiency of energy remains low. The filter is a filter limited by use for increasing the temperature of fluid, and therefore is poor in versatility in terms of enabling utilization for various uses.

Thus, in the conventional heat-generating devices, a part of obtained heat energy is utilized for other state change, and high energy is added in order to generate heat energy, energy efficiency remains low, and sufficient power saving is not attained.

The present invention has been made in order to solve the above problem, and an object of the present invention is to provide a heat-generating device capable of efficiently maintaining heat generation for a long time at a low cost while saving power.

Solution to Problem

As a result of intensive studies, the present inventors have found a new heat-generating device that obtains an unprecedented heat generation property of causing temperature rise in a short time, and thereafter maintaining the temperature constant after a fixed time, when a voltage is applied in a state where a certain kind of powder is mixed, that performs heat generation while saving power by utilizing this heat generation property, and that is portable by a compact configuration.

That is, a heat-generating device disclosed in the present application includes: a hollow vessel having an electrically insulated inner part; a pair of counter electrodes housed inside the vessel, and separated from and opposing each other; and a heat-generating body housed between the counter electrodes inside the vessel, and composed of silicon powder and carbon powder in a mixed state.

Thus, the hollow vessel having the electrically insulated inner part; the pair of counter electrodes housed inside the vessel, and separated from and opposing each other; and the heat-generating body housed between the counter electrodes inside the vessel, and composed of the silicon powder and the carbon powder in the mixed state, and therefore a current is propagated to the carbon powder having a conductive property by application of a voltage to the counter electrodes, the silicon powder that coexist in the mixed state has heat along with the carbon powder by the propagation of the current, the heat-generating body generates heat, and the heat-generating device can generate heat while saving power by a simple configuration, and can be utilized as an optimum heat source for maintaining a heat retention state.

In the heat-generating device disclosed in the present application, the vessel is formed from a heat conductive material having at least an inner part subjected to electrically insulating treatment, as necessary. Thus, the vessel is formed from the heat conductive material having at least the inner part subjected to the electrically insulating treatment, and therefore the heat-generating device is formed from the vessel having thermal conductivity, the inner part of this vessel is electrically insulated, and the heat-resisting property of the inner part of this vessel is enhanced at the same time, and a heat-generating device that is strong against heat generation from the heat-generating body, and becomes easy to carry is implemented.

The heat-generating device disclosed in the present application includes an elastic body near non-opposite surface sides of the counter electrodes, as necessary. Thus, the elastic body is provided near the non-opposite surface sides of the counter electrodes, and therefore also in a case where the volume of the inner part of the vessel expands due to the heat generation by the heat-generating body, the elastic body acts as an absorber that absorbs the expansion, durability of the vessel is enhanced, and a heat-generating device that is strong against the heat generation from the heat-generating body and is easy to carry is implemented.

In the heat-generating device disclosed in the present application, the vessel is composed of an elastic body, as necessary. Thus, the vessel is composed of the elastic body, and therefore also in a case where the volume of the inner part of the vessel expands due to the heat generation by the heat-generating body, the vessel itself acts as the absorber that absorbs the expansion, durability of the inner part of the vessel is enhanced, and a heat-generating device that is strong against the heat generation from the heat-generating body and is easy to carry is implemented.

In the heat-generating device disclosed in the present application, the silicon powder and the carbon powder each have a particle diameter of 5 to 150 μm, as necessary. Thus, the silicon powder and the carbon powder each have a particle diameter of 5 to 150 μm, and therefore a powder mixed state in which a current is easily conducted between the counter electrodes is formed, and it is possible to stably improve heat exchange efficiency.

In the heat-generating device disclosed in the present application, the heat-generating body contains incinerated ash, as necessary. Thus, the heat-generating body contains the incinerated ash, and therefore even when the carbon powder expands by electric conduction (electrical conduction), connection relation between the silicon powder and the carbon powder is uniformized, and electrical conductivity in the whole heat-generating body can be maintained constant. Furthermore, a discrete state of the silicon powder and the carbon powder is made uniform by this incinerated ash, and even when the carbon powder expands by electric conduction (electrical conduction), a heating value (Joule heat) can be determined by a constant conductive property in this heat-generating body.

A method for producing a heat-generating device disclosed in the present application including the step of mixing the silicon powder and the carbon powder to obtain the heat-generating body. Thus, the heat-generating body is formed only by mixing these powders, and therefore it is possible to produce an excellent heat source at a low cost.

In the method for producing a heat-generating device disclosed in the present application, the silicon powder and the carbon powder are mixed by agitation and/or vibration, as necessary. Thus, these powders are mixed by agitation and/or vibration, and therefore the mixed state is formed in a higher dispersion state, and it is possible to produce an excellent heat source by a simple method.

In the method for producing a heat-generating device disclosed in the present application, a heating value of the heat-generating body is controlled on the basis of particle sizes, particle diameters, and/or a compounding ratio of the silicon powder and the carbon powder, as necessary. Thus, the heating value of the heat-generating body is controlled on the basis of the particle sizes, the particle diameters, and/or the compounding ratios of the silicon powder and the carbon powder, and therefore the heat-generating body having a desired heating value is easily obtained in accordance with the use, and an excellent heat source having a heat generation property in accordance with the use can be produced at a low cost by a simple configuration.

DESCRIPTION OF EMBODIMENTS

First Embodiment

A heat-generating device according to a first embodiment of the present application will be described in accordance with a configuration diagram of FIG. 1.

Figure 1:
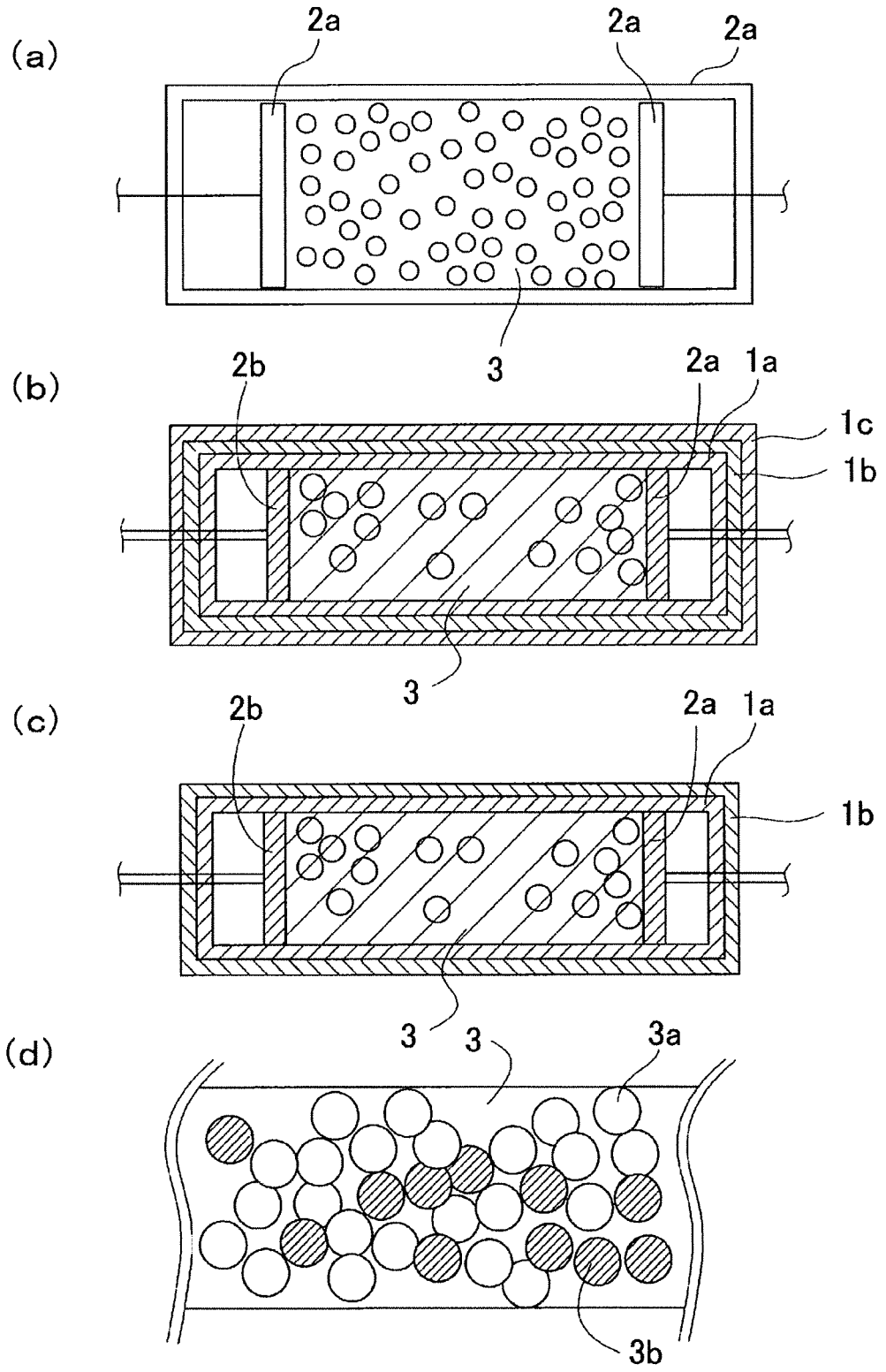
FIG. 1 illustrates a configuration diagram by a sectional view of a heat-generating device according to a first embodiment of the present application.

As illustrated in FIG. 1(*a*), the heat-generating device according to the first embodiment includes a hollow vessel 1 having an electrically insulated inner part, a pair of counter electrodes 2 housed inside this vessel 1, and composed of a first electrode 2*a* and a second electrode 2*b* separated from and opposing each other, and a heat-generating body 3 housed between the counter electrodes 2 inside this vessel 1, and composed of silicon powder 3*a* and carbon powder 3*b* in a mixed state.

As long as the inner part is electrically insulated, a material of the vessel 1 even metal or non-metal is not particularly limited, but is preferably formed from a heat conductive material 1*b* having a surface coated with an inside insulation part 1*a* having at least the inner part (inside surface) of the vessel 1 subjected to electrically insulating treatment, as illustrated in FIG. 1(*b*).

As the heat conductive material 1*b*, even metal or non-metal, any material having thermal conductivity is not particularly limited, and aluminum, copper, or ceramics is preferable.

As long as an insulating property is provided, the inside insulation part 1*a* is not particularly limited. As an example, coating by alumite treatment can be used. In addition to this, ceramics can be used. As the heat conductive material 1*b*, any metal having thermal conductivity such as aluminum and copper can be used. In addition to this, ceramics can be used.

For example, in a case where aluminum is used as the heat conductive material 1*b*, coating by alumite treatment having high affinity with aluminum is preferably used as the inside insulation part 1*a*. In this case, reduction in weight is implemented by aluminum, the heat conductive material 1*b* is formed by simply subjecting the surface of aluminum to alumite treatment, and production and handling become easy. For example, in a case where ceramics is used as the heat conductive material 1*b*, ceramics can be used also as the inside insulation part 1*a*, and production and handling become easy by a simple configuration.

Furthermore, the material of the vessel 1 is preferably formed from the heat conductive material 1*b* having a surface coated with an outside insulation part 1*c* having an outer surface (outside surface) of this vessel 1 subjected to electrically insulating treatment, as illustrated in FIG. 1(*b*). Similarly to the inside insulation part 1*a*, also in the outside insulation part 1*c*, for example, in a case where aluminum is used as the heat conductive material 1*b*, coating by alumite treatment is preferably used. For example, in a case where ceramics is used as the heat conductive material 1*b*, ceramics can be used also for the outside insulation part 1*c*, and production and handling become easy. Additionally, temperature retaining capability is high, and therefore a heat storage property can be enhanced. Furthermore, it is possible to maintain a high temperature state generated by a heater for a long time while saving power.

Thus, also in the outer surface of this vessel 1, an insulating property and a heat-resisting property of an outer part of this vessel 1 are simultaneously enhanced by the outside insulation part 1*c* subjected to the electrically insulating treatment, and it is possible to generate heat while suppressing influence of temperature change of the outer part. For example, liquid such as water can be easily directly heated by the insulating property of the outer surface of this vessel 1, and as this application, utilization as a heat pipe utilizing movement of heat generated by contact with hydraulic fluid is possible.

The material of vessel 1 is not limited to the heat conductive material 1*b* coated with the above c and the outside insulation part 1*c*. For example, as illustrated in FIG. 1(*c*), formation from a heat conductive material 1*b* having a surface coated with an inside insulation part 1*a* having only an inner part subjected to electrically insulating treatment is sufficiently preferable from a viewpoint of exerting a high insulating property and a high heat-resisting property.

For example, in a case where aluminum is used as this heat conductive material 1*b*, and coating by alumite treatment is used as this inside insulation part 1*a*, this vessel 1 is formed from aluminum in which at least the inner part is subjected to the alumite treatment, and therefore by aluminum subjected to the alumite treatment, the vessel 1 is formed of aluminum that is lightweight metal, and the inner part of this vessel 1 is electrically insulated, and the heat-resisting property of the inner part of this vessel 1 is enhanced at the same time. Additionally, the device becomes strong against temperature increase by heat generation from the heat-generating body of the inner part, and becomes easy to carry. For example, in a case where ceramics is used as the heat conductive material 1*b*, ceramics can be used also as the inside insulation part 1*a*, and production and handling become easy by a simple configuration.

The material of the vessel 1 is not limited to the above, and, for example, a resin material such as plastics and glass can be used.

Shapes of the first electrode 2*a* and the second electrode 2*b* composing the counter electrodes 2 are not particularly limited, and can be linear shapes, or planar shapes, but are more preferably the planar shapes. When the shapes are the planar shapes, the areas are changed in accordance with various uses, so that it is possible to freely control so as to obtain a desired temperature rise speed.

As an applied voltage, an alternating current or a direct current can be utilized. Therefore, power supply design such as power supply from a small dry cell, large-capacity power supply from an AC power receptacle is freely performed, and flexible designing such as space saving or increase in size is possible in accordance with purposes.

As illustrated in FIG. 1(*d*), the heat-generating body 3 is formed as a mixed state where the silicon powder 3*a* and the carbon powder 3*b* are mixed with each other. As to this mixed state, the degree of mixing of the power is not particularly limited, the silicon powder 3*a* and the carbon powder 3*b* only need to be uniformly dispersed, and is preferably a state where powder is uniformly mixed. A method for forming this mixed state is not particularly limited, and for example, the mixed state can be formed by agitating or vibrating these silicon powder 3*a* and carbon powder 3*b*.

The silicon powder 3*a* that becomes a raw material is not particularly limited, regenerated silicon that is secondarily exhausted and disposed in a great quantity at the time of semiconductor production can be used as a raw material, and resources can be effectively reused. From such a point, the silicon powder 3*a* may contain silicon carbide powder as other component.

Although the carbon powder 3*b* is not particularly limited, carbon (for example, carbon black) that is secondarily exhausted and disposed in a great quantity at the time of production of batteries such as secondary batteries is preferably used as a raw material, and there is excellent advantages that it is possible to suppress not only production cost but also environmental load by effective use by reuse of resources.

As the method for producing the heat-generating device according to the first embodiment, a method for obtaining the heat-generating body 3 by mixing these silicon powder 3*a* and carbon powder 3*b* is used. Thus, the heat-generating body 3 is formed only by mixing these powders, and therefore it is possible to produce an excellent heat source at a low cost by a simple configuration.

As the method for producing the heat-generating device, these silicon powder 3*a* and carbon powder 3*b* can be mixed by agitation and/or vibration. For example, an agitator can be used for the agitation, and for example, an ultrasonic vibrator can be used for the vibration. Thus, these powders are mixed by agitation and/or vibration, and therefore the mixed state is formed in a higher dispersion state, and it is possible to produce an excellent heat source by a simple method.

As the method for producing the heat-generating device, a heating value of the heat-generating body 3 can be controlled on the basis of the particle sizes, the particle diameters, and/or the compounding ratio of the silicon powder 3*a* and the carbon powder 3*b*.

The particle diameters of these silicon powder 3*a* and carbon powder 3*b* are not particularly limited, but each of these silicon powder 3*a* and carbon powder 3*b* preferably has a particle diameter of 5 to 150 μm. Thus, the silicon powder 3*a* and the carbon powder 3*b* each have a particle diameter of 5 to 150 μm, so that powder mixed state in which a current is easily conducted is easily formed between the counter electrodes 2, and it is possible to stably improve heat exchange efficiency.

The particle diameters of these silicon powder 3*a* and carbon powder 3*b* are not particularly limited, but each are more preferably a particle diameter of 30 to 100 μm from a viewpoint that a resistance value suitable for causing heat generation as the whole heat-generating body 3 is easily obtained. This suitable resistance value is preferably 7 to 10Ω, and is more preferably 8Ω. This resistance value is a resistance value measured from a power supply device side, and therefore power supply design becomes easy. Additionally, control of power supply can be performed not by CC but by CV, and therefore driving can be performed not by a dedicated power supply but by a general inexpensive power supply device. Even in a case where a commercially available dry cell is used as a power supply, stable heat generation can be performed.

The control of the heating value can be performed by particle diameter control of these silicon powder 3*a* and carbon powder 3*b*. For example, these silicon powder 3*a* and carbon powder 3*b* having small particle diameters are used, so that the resistance value is reduced, and the heating value can be increased. Additionally, these silicon powder 3*a* and carbon powder 3*b* having large particle diameters are used, so that the resistance value is increased, and control for suppressing the heating value can be performed.

The particle sizes of these silicon powder 3*a* and carbon powder 3*b* are not particularly limited. However, a conductive property can be enhanced by uniformizing the particle sizes, and the resistance value (heating value) can be increased by making the particle sizes ununiform.

The compounding ratio of these silicon powder 3*a* and carbon powder 3*b* is adjusted, so that a heat generation property can be controlled. For example, in a case where the ratio of the silicon powder 3*a* is increased, a heating value can be increased from a viewpoint that the component easily generates heat, and the ratio of the component of the insulating property easily increases. In a case where the ratio of the carbon powder 3*b* is increased, control for further suppressing the heating value can be performed from a viewpoint that the ratio of the electrically conductive component is easily increased.

Thus, the heating value of the heat-generating body 3 can be controlled on the basis of the particle sizes, the particle diameters, and/or the compounding ratio of the silicon powder 3*a* and the carbon powder 3*b*, and therefore an excellent heat source having a heat generation property in accordance with the use is easily obtained, and it is possible to freely perform power supply design, and produce this heat-generating device at a low cost.

Respective pH values of these silicon powder 3*a* and carbon powder 3*b* are not particularly limited, but are each preferably near a neutral region. However, the pH values are not limited to this, and can be an acid region or an alkaline region.

The shape of the heat-generating device according to the first embodiment is not particularly limited, but is preferably a cylindrical shape from a point of easily handling as illustrated in FIG. 1(*e*). In addition to this, as long as the shape is hollow, the shape of the heat-generating device may be a cube, a rectangular parallelepiped or the like, and is not particularly limited. Furthermore, for example, the shape of the heat-generating device can be a bent shape (for example, an S-shape, a U-shape), a spherical shape, or an elliptical shape in which the inner part is in a hollow state.

With such a configuration, in the heat-generating device according to this embodiment, even power saving, the rise speed of the heat source is fast, and a desired temperature setting is facilitated. Furthermore, for example, the heat-generating device can be utilized for heat retention for a long time by utilizing surplus power such as midnight power. It is confirmed that the heat-generating device according to this embodiment exerts excellent heat generating performance of sufficiently generating heat even a small power of about 3(10) watts (refer to an example described below).

From this, in the heat-generating device according to this embodiment, even weak power of natural energy such as solar power generation, wind power generation, and small hydroelectric generation can be utilized. Even in a condition where commercial power is not provided, or such a region, an excellent effect capable of utilizing for heat generating use without any problem is exerted.

Thus, a detailed mechanism in which the heat-generating device according to this embodiment exerts the excellent effects is not clarified in detail. However, the silicon powder 3*a* and the carbon powder 3*b* composing the heat-generating body 3 is formed in a mixed state, so that a current propagates to the carbon powder 3*b* having a conductive property when a voltage is applied to the counter electrodes 2. By this propagation of the current, the silicon powder 3*a* that coexists in the mixed state generates heat and acts. Additionally, it is guessed that the silicon powder 3*a* and the carbon powder 3*b* squeeze in a narrow region at high integration, and the heat-generating body generates heat at an atomic level. The silicon powder 3*a* and the carbon powder 3*b* are in the mixed state in contact with each other, and therefore the electrically oriented state of each powder are arrayed in a state where a current easily flows by applying a voltage to each powder. It is guessed that a situation in which heat from the silicon powder 3*a* mainly having an insulating property depending on conduction of a current Thus, the heat-generating device according to this embodiment can generate heat while power saving by a simple configuration, and can be utilized as an optimum heat source for the maintenance of a heat retention state. Additionally, for example, snowing treatment in snowing time in a cold area or the like can be utilized.

Second Embodiment

A heat-generating device according to a second embodiment of the present application will be described in accordance with a configuration diagram of FIG. 2.

Figure 2:
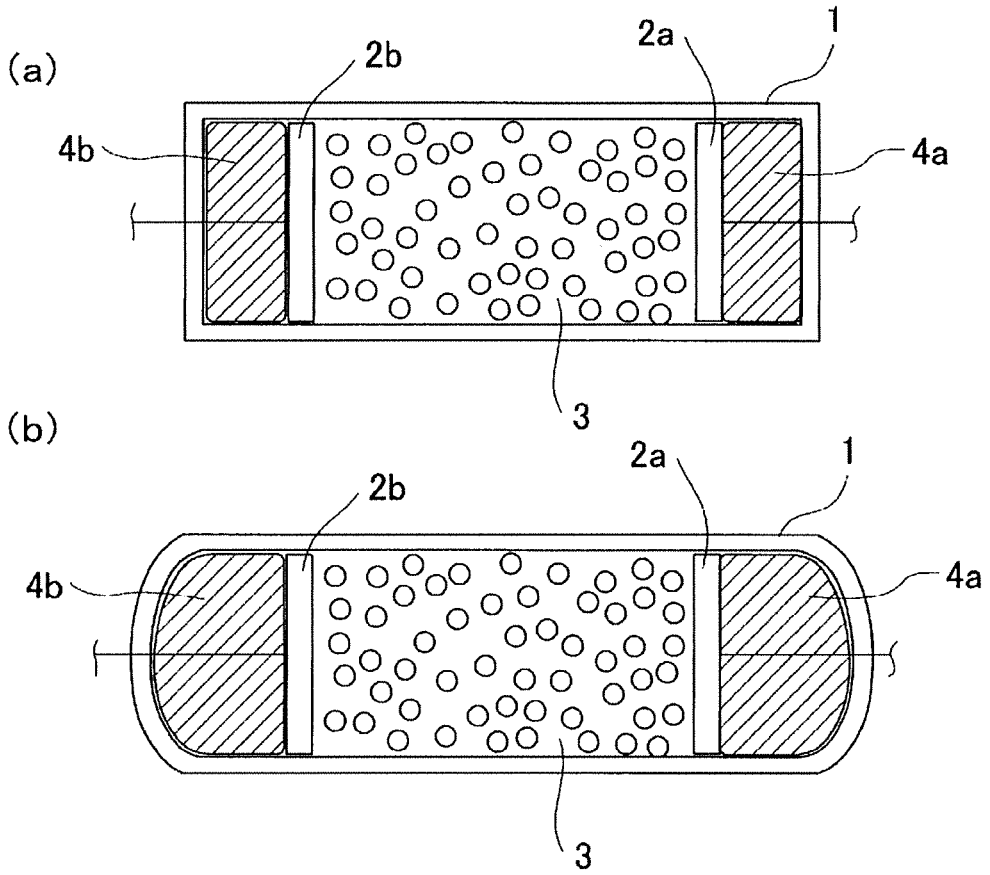
FIG. 2 illustrates a configuration diagram by a sectional view of a heat-generating device according to a second embodiment of the present application.

The heat-generating device according to the second embodiment includes the vessel 1, a pair of the counter electrodes 2 composed of the first electrode 2*a* and the second electrode 2*b*, and the heat-generating body 3 composed of the silicon powder 3*a* and the carbon powder 3*b* similarly to the heat-generating device according to the above first embodiment, and further includes elastic bodies 4 (a first elastic body 4*a* and a second elastic body 4*b*) disposed near non-opposite surface sides of the respective counter electrode (a first electrode 2*a* and a second electrode 2*b*), as illustrated in FIG. 2(*a*).

This elastic bodies 4 are not particularly limited, but for example, heat-resisting rubber, Teflon, ceramics or the like can be used.

As illustrated in FIG. 2(*b*), when the heat-generating body inside the vessel 1 generates heat, and thermally expands, the elastic bodies 4 change their shapes to absorb the expansion as buffer materials, and can suppress damage of the vessel 1 due to the heat generation of the heat-generating body. That is, the elastic bodies 4 are provided near the non-opposite surface sides of the counter electrodes 2, and therefore also in a case where the volume of the inner part of the vessel 1 expands due to the heat generation by this heat-generating body 3, the elastic body acts as an absorber that absorbs the expansion, durability of the inner part of this vessel 1 is enhanced, and a heat-generating device that is stronger against the heat generation from the heat-generating body 3 and easy to carry is implemented.

Third Embodiment

A heat-generating device according to a third embodiment of the present application will be described in accordance with a configuration diagram of FIG. 3.

Figure 3:
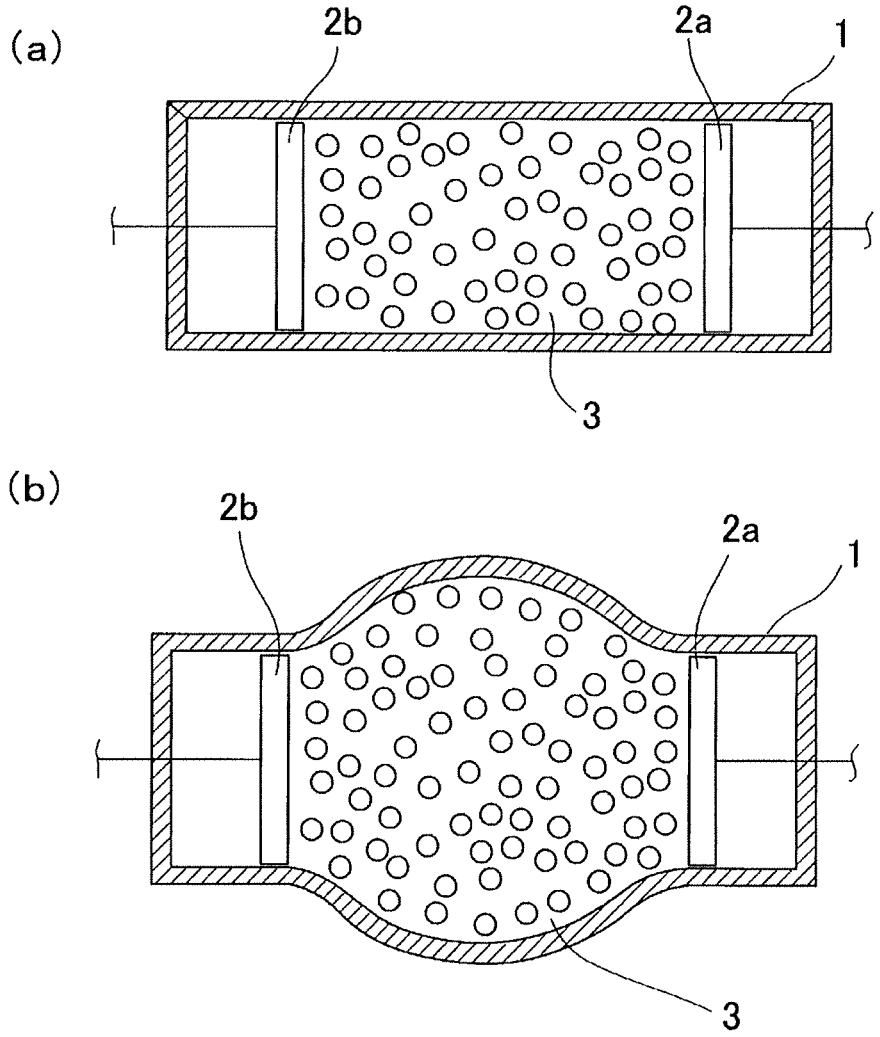
FIG. 3 illustrates a configuration diagram by a sectional view of a heat-generating device according to a third embodiment of the present application.

The heat-generating device according to the third embodiment includes the vessel 1, a pair of the counter electrodes 2 composed of the first electrode 2*a* and the second electrode 2*b*, and the heat-generating body 3 composed of the silicon powder 3*a* and the carbon powder 3*b* similarly to the heat-generating device according to the above first embodiment, and the vessel 1 is formed from an elastic body as illustrated in FIG. 3(*a*).

The elastic body forming this vessel 1 is not particularly limited, but for example, the rubber, ceramics or the like can be used.

As illustrated in FIG. 3(*b*), when the heat-generating body inside the vessel 1 generates heat, and thermally expands, the vessel 1 formed from this elastic body functions also as a buffer material, receives the thermal expansion to change a shape, absorbs the expansion, and can suppress damage of the vessel 1 from the thermal expansion due to the heat generation of the heat-generating body 3. That is, this vessel 1 is formed from the elastic body, and therefore even in a case where the volume of the inner part of the vessel 1 expands due to the heat generation by this heat-generating body 3, the vessel 1 functions also as an absorber that absorbs the expansion by action of the elastic body, durability of this vessel 1 is enhanced, and a heat-generating device that is stronger against the heat generation from the heat-generating body 3 and easy to carry is implemented.

Fourth Embodiment

A heat-generating device according to a fourth embodiment of the present application will be described in accordance with a configuration diagram of FIG. 4.

Figure 4:
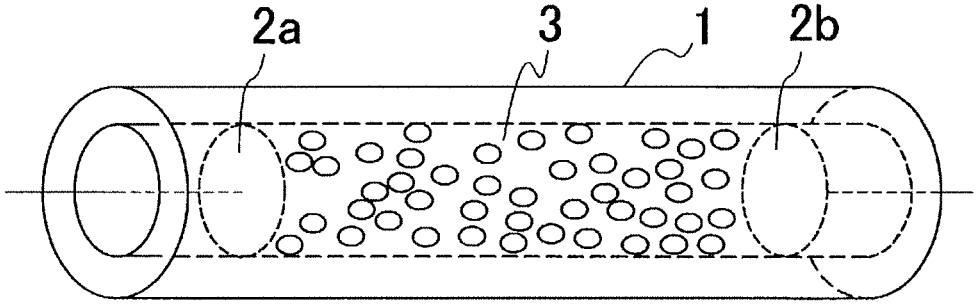
FIG. 4 illustrates a configuration diagram by a perspective view of a heat-generating device according to a fourth embodiment of the present application.

The heat-generating device according to the fourth embodiment includes the vessel 1, a pair of the counter electrodes 2 composed of the first electrode 2*a* and the second electrode 2*b*, the heat-generating body 3 composed of the silicon powder 3*a* and the carbon powder 3*b*, and the elastic bodies 4 composed of the first elastic body 4*a* and the second elastic body 4*b* similarly to the heat-generating device according to the above second embodiment, and is further configured as a stick-shaped heat-generating device as illustrated in FIG. 4.

Thus, since the heat-generating device according to this embodiment has a simple structure, and the number of necessary components is reduced, operation of the device is stabilized, and a low-cost and freely portable heat-generating device is obtained. With this shape, for example, a compact configuration is implemented by utilizing a small microcell as a power source. Additionally, with this compact configuration, for example, the heat-generating device is mounted on an inner part of a palm portion of a robot, so that an outer surface of the palm of the robot can be warmed to a moderate body temperature similar to human skin (for example, about 40° C. to 50° C.), and it is possible to implement a human skin robot that gives warm feeling like human skin at the time of shaking hands.

Fifth Embodiment

Figure 5:
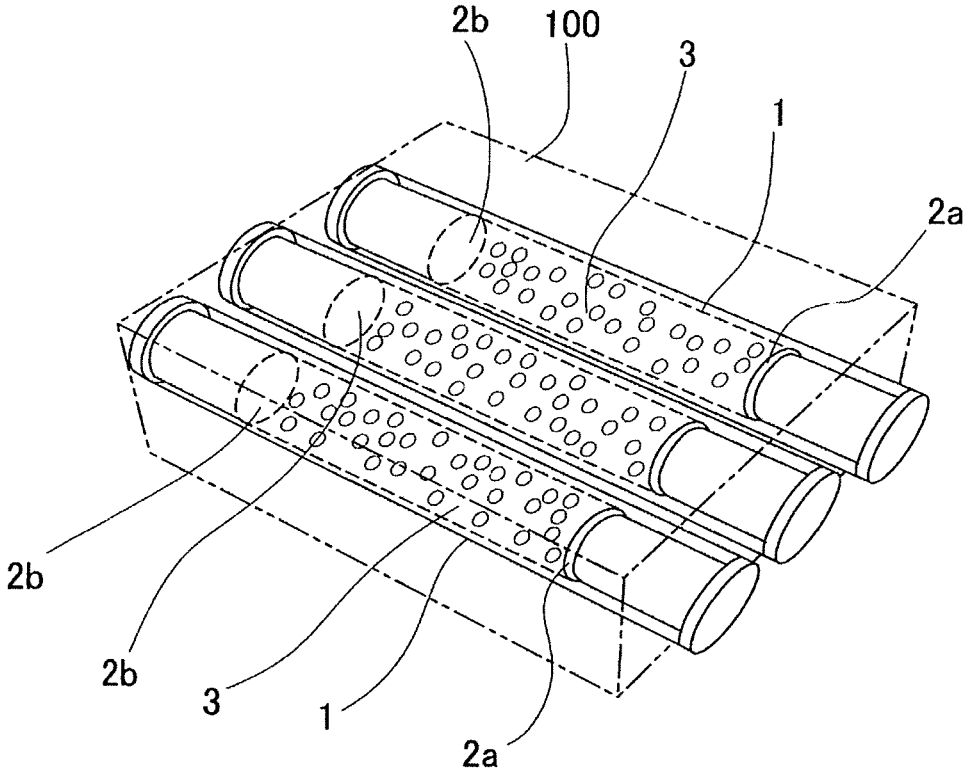
FIG. 5 illustrates a configuration diagram by a perspective view of a heat-generating device according to a fifth embodiment of the present application.

A heat-generating device according to a fifth embodiment of the present application will be described in accordance with a configuration diagram of FIG. 5.

The heat-generating device according to the fifth embodiment includes the vessel 1, a pair of the counter electrodes 2 composed of the first electrode 2*a* and the second electrode 2*b*, the heat-generating body 3 composed of the silicon powder 3*a* and the carbon powder 3*b*, and the elastic bodies 4 composed of the first elastic body 4*a* and the second elastic body 4*b* similarly to the heat-generating device according to the above fourth embodiment. Additionally, a plurality of the heat-generating devices are formed in stick shapes, and the heat-generating device is further configured from a housing vessel 100 that houses a plurality of the heat-generating devices, as illustrated in FIG. 5. The housing vessel 100 is not particularly limited, but an insulator such as plastics can be used.

Thus, the heat-generating device according to this embodiment is configured from the housing vessel 100 that houses a plurality of the stick-shaped heat-generating devices, and therefore heat generation inside the housing vessel 100 in a superimposed manner is performed, efficient heat generation is maintained for a long time, and the heat-generating device can be utilized as a further enlarged heat-generating device. For example, oil as a heating medium is introduced into the inner part, so that for example, application as an oil heater of about 1500 W is possible. Additionally, hydraulic fluid is introduced into the housing vessel 100, so that the heat-generating device can be utilized as a heat pipe.

Sixth Embodiment

A heat-generating device according to a sixth embodiment of the present application will be described in accordance with a configuration diagram of FIG. 6 and FIG. 7.

Figure 6:
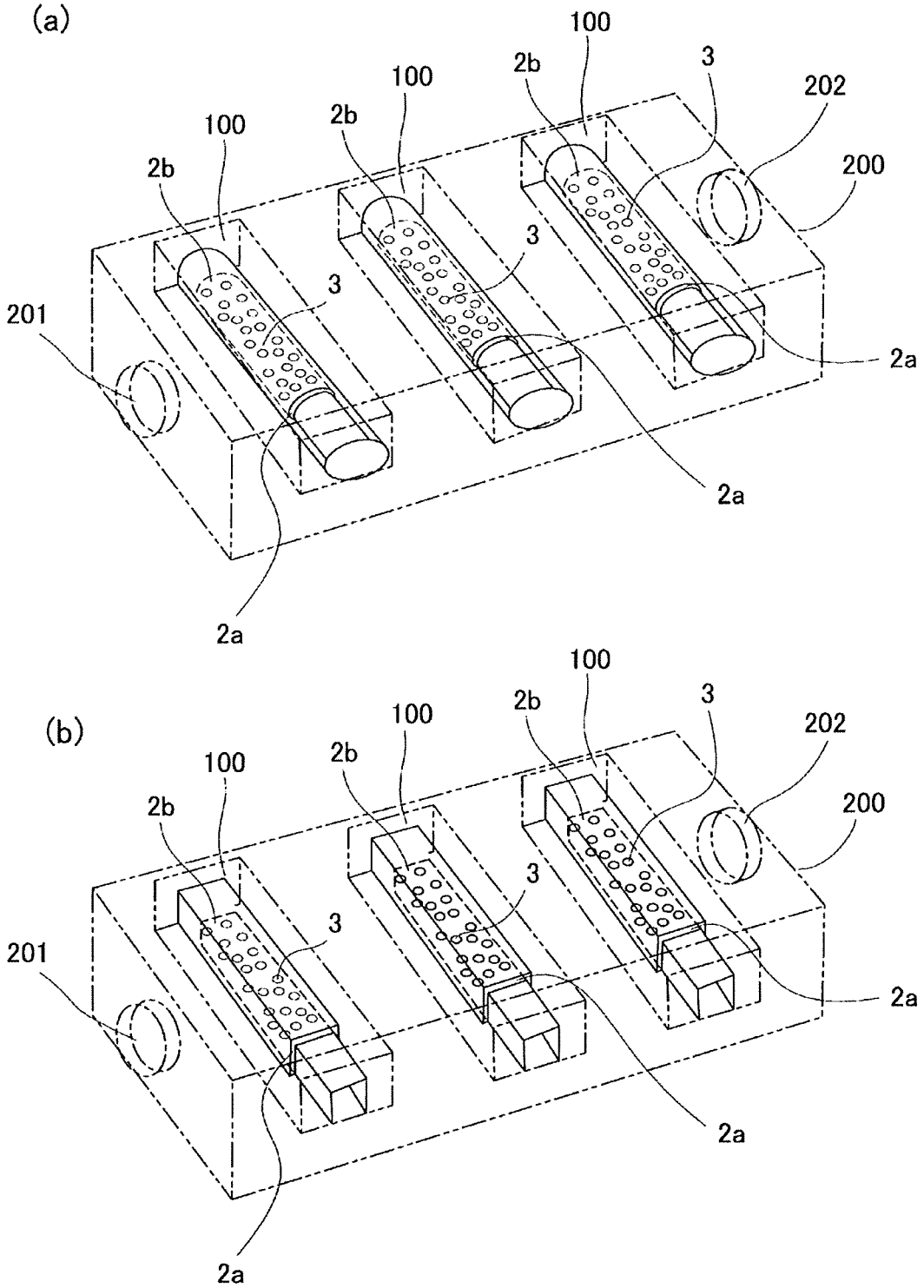
FIG. 6 illustrates a configuration diagram by a perspective view of a heat-generating device according to a sixth embodiment of the present application.
Figure 7:
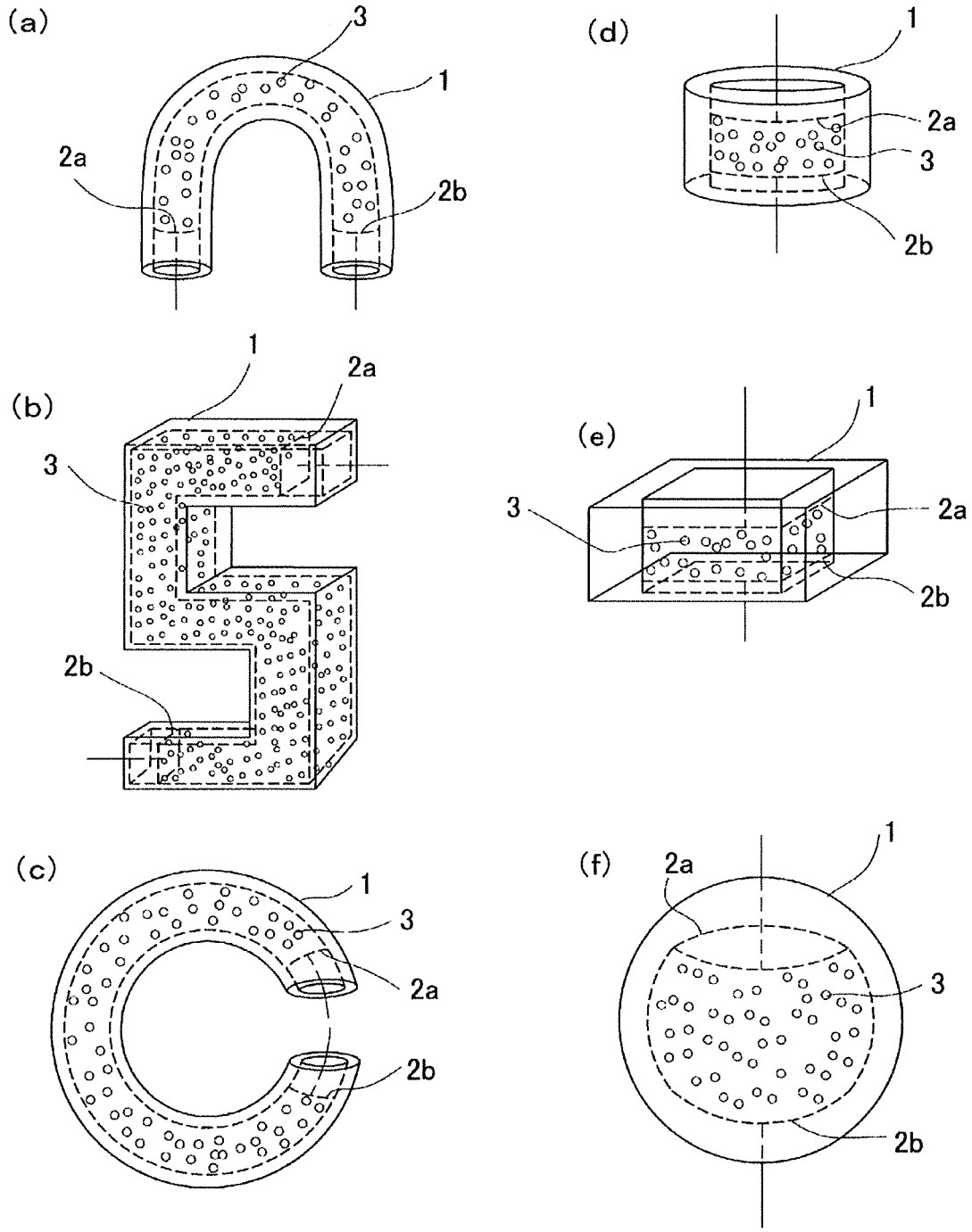
FIG. 7 illustrates a configuration diagram by a perspective view of a shape example of the heat-generating device according to the sixth embodiment of the present application.

The heat-generating device according to the sixth embodiment includes the vessel 1, a pair of the counter electrodes 2 composed of the first electrode 2*a* and the second electrode 2*b*, the heat-generating body 3 composed of the silicon powder 3*a* and the carbon powder 3*b*, and the elastic bodies 4 composed of the first elastic body 4*a* and the second elastic body 4*b* similarly to the heat-generating device according to the above fifth embodiment, and is further configured from a storing vessel 200 that houses a plurality of the housing vessels 100, circulates fluid from an introduction port 201 for introducing the fluid to an exhaust port 202 for exhausting the fluid, as illustrated in FIG. 6. The fluid can be gas or liquid. A shape of the heat-generating device is not particularly limited as long as the shape is hollow, and for example, can be a cylindrical body as illustrated in FIG. 6(*a*). Additionally, as illustrated in FIG. 6(*b*), the shape of the heat-generating device can be a rectangular parallelepiped, and device design having a desired shape can be freely performed in accordance with the use.

Thus, in the heat-generating device according to this embodiment, fluid comes into contact with the heat-generating devices of the inner part of the storing vessel 200 to be circulated, and therefore this fluid is stably heated, stable fluid temperature rise is maintained for a long time, and the heat-generating device can be utilized as a multipurpose heat-generating device using fluid. That is, the heat-generating device is applicable as a kettle having a simple configuration, or a water heater for a bathtub or a kitchen.

The shape of the heat-generating device is not particularly limited to a cylindrical body as exemplified in each of the above embodiments, as long as the shape is hollow. As an example of such various shapes, a bent shape such as a U-shape, an S-shape, a circular shape as illustrated in FIGS. 7(*a*) to 7(*c*), a microcell shaped columnar shape or a box shape as illustrated in FIGS. 7(*d*) to 7(*e*), or a spherical shape as illustrated in FIG. 7(*f*) can be used. Thus, the shape and the size of the heat-generating device can be freely designed, and therefore the heat-generating device having the desired shape and size in various uses is utilized, so that it is possible to apply the heat-generating device to heat generation use in a wide field.

Thus, in the heat-generating device according to this embodiment, fluid comes into contact with the heat-generating devices of the inner part of the storing vessel 200 to be circulated, and therefore this fluid is stably heated, stable fluid temperature rise is maintained for a long time, and the heat-generating device can be utilized as a multipurpose heat-generating device using fluid. That is, the heat-generating device is applicable as a kettle having a simple configuration, or a water heater for a bathtub or a kitchen.

Other Embodiments

In the heat-generating device according to each of the above embodiments, the heat-generating body 3 contains the silicon powder 3*a* and the carbon powder 3*b* as constitutive substances. However, other constitutive substances are not particularly limited, and various substances can be mixed in accordance with purposes or uses.

As other constitutive substances contained in this heat-generating body 3, a particle diameter, or the like is not preferably particularly limited, but powdery substances are preferable, and the constitutive substances more preferably contain incinerated ash. As the incinerated ash, incinerated ash that is secondarily exhausted in a great quantity in an ironworks or a thermal power plant can be used, fly ash is more suitably used. In addition to these, blast furnace slag powder, silica fume, or the like can be used. The particle diameter of the incinerated ash is not particularly limited, but a particle diameter of about 30 to 70 μm is suitably preferable.

Figure 8:
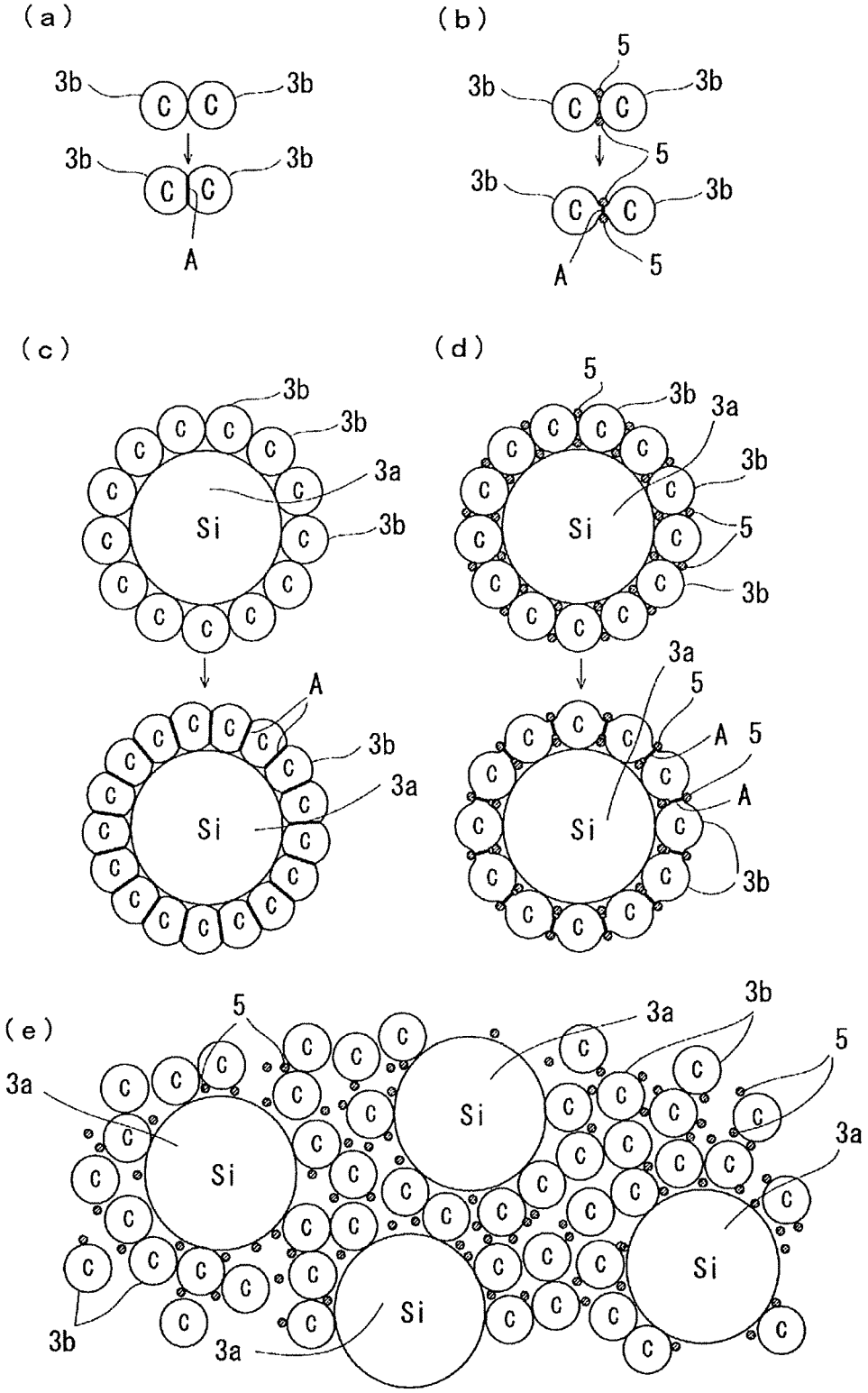
FIG. 8 illustrates a configuration diagram by a perspective view illustrating a configuration example of a heat-generating device according to another embodiment of the present application.

As illustrated in FIG. 8(*a*), the carbon powder 3*b* contained in a mixed state expands in this heat-generating body 3 by electric conduction with the lapse of heat generation time, a contact surface a between the carbon powder 3*b* is increased. However, the carbon powder 3*b* has a conductive property, and therefore by the increase of this contact surface a, the conductive property in this heat-generating body 3 is enhanced, and a resistance component is lowered, so that the heat generating property tends to slightly lower slowly with time.

On the other hand, as illustrated in FIG. 8(*b*), in a case where incinerated ash 5 is contained in this heat-generating body 3, when the carbon powder 3*b* contained in a mixed state expands by electric conduction with the lapse of heat generation time, this incinerated ash 5 is contained, so that increase of a contact surface a formed between the carbon powder 3*b* is suppressed, the conductive property in this heat-generating body 3 is suppressed, and lowering of a resistance component is suppressed, so that it is possible to maintain a high heat generating property with time.

That is, as illustrated in FIG. 8(*c*), in a case where the incinerated ash 5 is not contained in this heat-generating body 3, the carbon powder 3*b* expands by electric conduction (electrical conduction) in this heat-generating body 3 in a state where the silicon powder 3*a* and the carbon powder 3*b* are mixed, the contact surface a between the carbon powder 3*b* is increased, and the heat generating property tends to slightly lower slowly with time. On the other hand, in a case where the incinerated ash 5 is contained in this heat-generating body 3, even when the carbon powder 3*b* expands in this heat-generating body 3 by electric conduction (electrical conduction) as illustrated in FIG. 8(*d*), increase of the contact surface a between the carbon powder 3*b* is suppressed, and it is possible to maintain a high heat generating property with time.

Thus, as illustrated in FIG. 8(*e*), the incinerated ash 5 is contained in this heat-generating body 3, so that even when the carbon powder 3*b* expands by electric conduction (electrical conduction), connection relation between the silicon powder 3*a* and the carbon powder 3*b* is uniformized, and electrical conductivity in the whole heat-generating body 3 can be maintained constant. Furthermore, a discrete state of the silicon powder 3*a* and the carbon powder 3*b* is made uniform by this incinerated ash 5, and even when the carbon powder 3*b* expands by electric conduction (electrical conduction), a heating value (Joule heat) can be determined by a constant conductive property in this heat-generating body 3.

In order to further clarify characteristics of the present invention, an example is described below. However, the present invention is not limited to this example.

Example 1

In accordance with the above fourth embodiment, as illustrated in FIG. 4, a sample of a stick-shaped heat-generating device formed in a columnar shape, having an outer shape of 12 mm, and a whole length of 170 mm was prepared. As a vessel, a housing was formed of ceramics, copper was used for counter electrodes in the housing, silicon powder of 30 to 60 μm that utilized regenerated silicon, carbon powder of 30 to 60 μm that was disposed for production of a battery such as a secondary battery were housed in the housing, the housing was fastened by a cap made of plastics, and an outer part of the cap was fixed by a nut. A constant power (6 cases of 3 W, 12 W, 35 W, 54 W, 62 W, and 90 W) was applied to the sample for 30 minutes.

Figure 9:
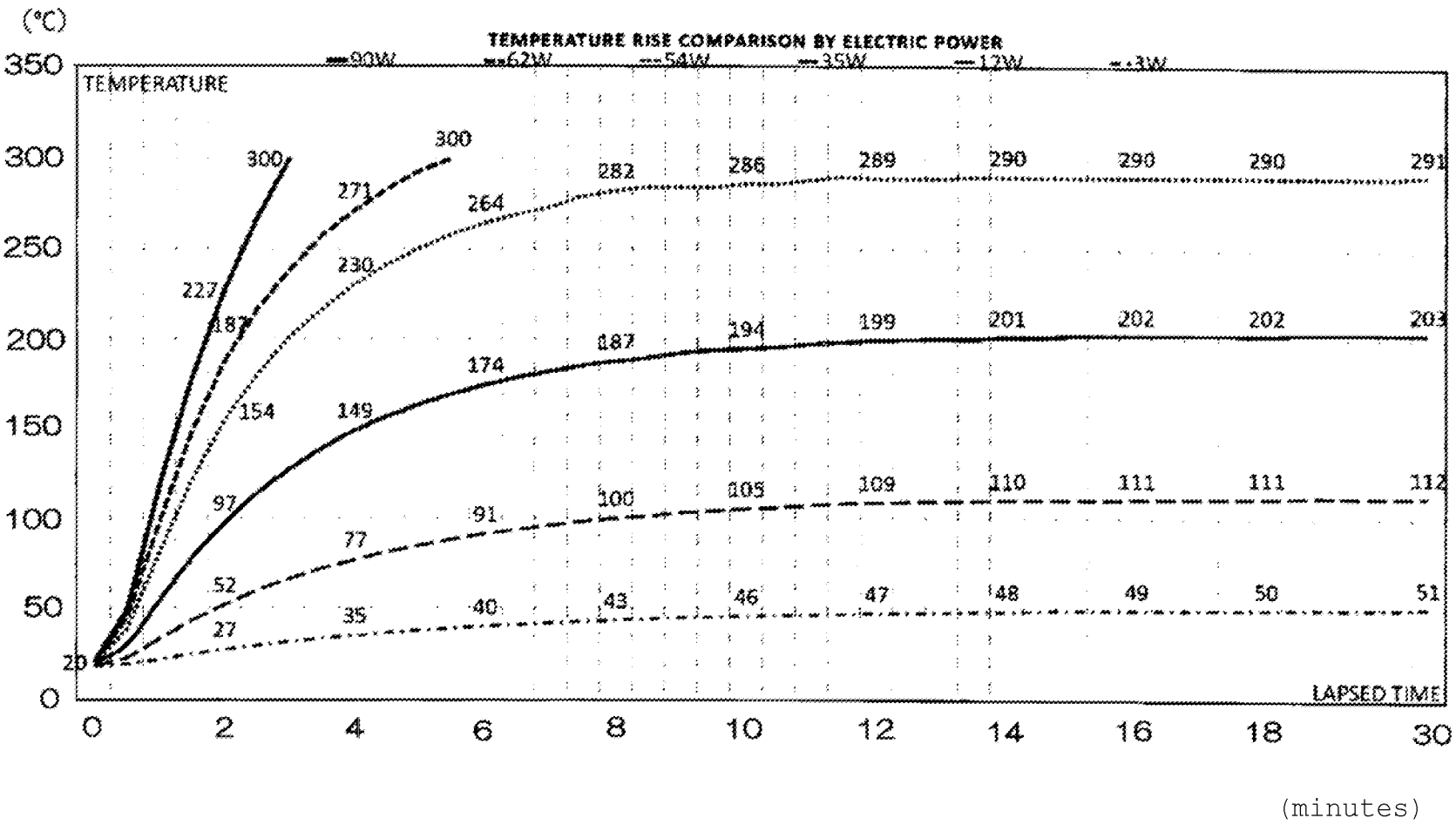
FIG. 9 illustrates a result obtained by applying a voltage to a heat-generating device according to Example 1 for 30 minutes.

As to a result obtained by applying a voltage to the sample of the above heat-generating device for 30 minutes, a result of temperature rise with time per electric energy (W) is illustrated in FIG. 9. From the obtained result, it has been confirmed from FIG. 9 that a steep temperature rise after one or two minutes is confirmed, and even when 30 minutes elapse, the increased temperature is not lowered, and a constant temperature is maintained. Particularly, from the obtained result, after approximately 8 to 12 minutes in the elapsed time in the figure, minute fluctuation in temperature change is confirmed, and therefore it is guessed that a mixed state of silicon powder and carbon powder changes in this time frame, electrical conductivity and thermal conductivity are changed by the change of the powder mixed state, so that it has been confirmed that transition from a temperature rising situation to a constant temperature maintaining situation is performed.

Figure 10:
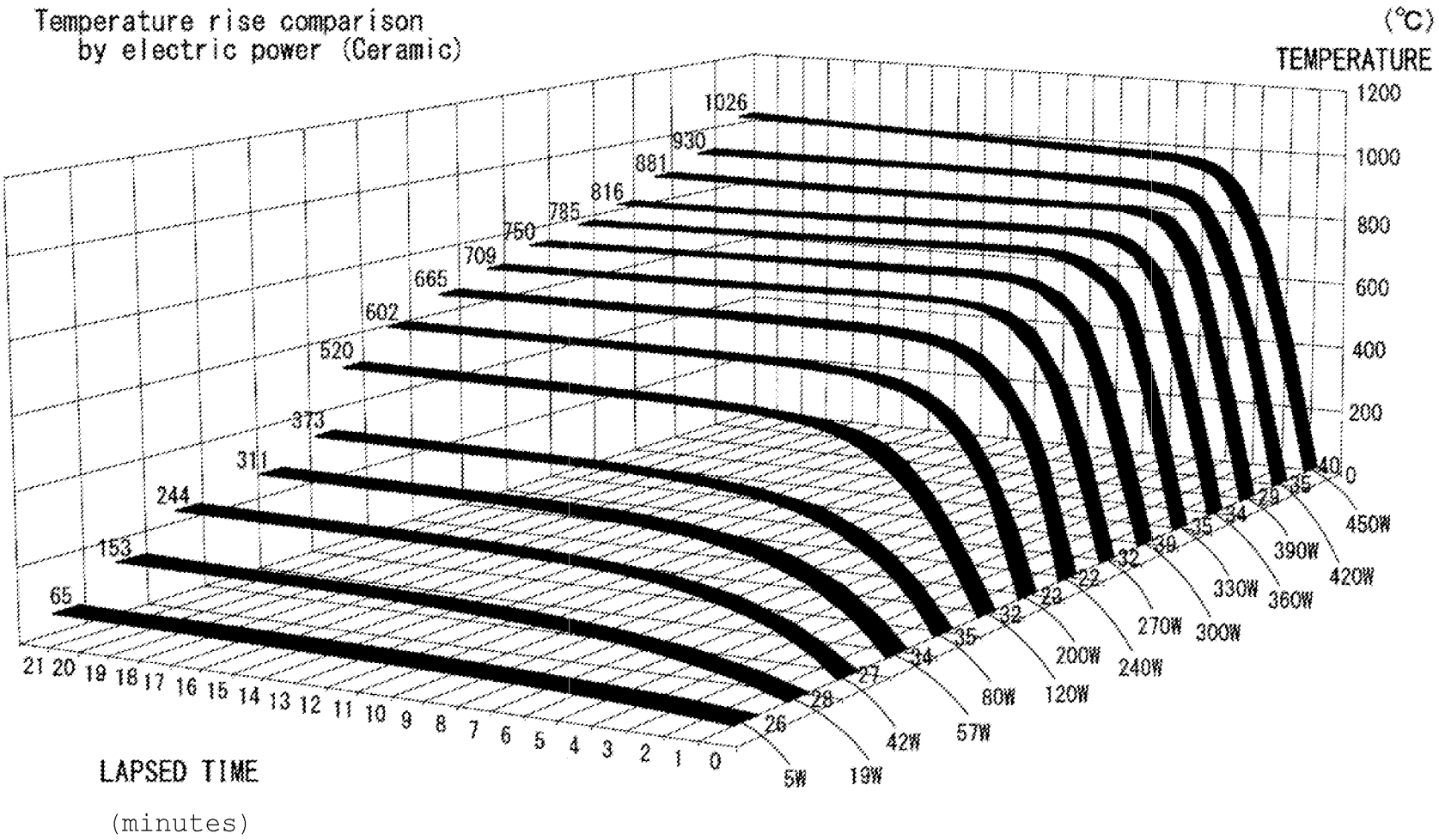
FIG. 10 illustrates a result obtained by applying a voltage to a heat-generating device according to Example 1 for 30 minutes.

Furthermore, by being scaled up, as to a result obtained by applying a voltage up to electric energy 450 W to a sample of the above heat-generating device obtained by adding fly ash powder of 30 to 70 μm in the above housing, a result of temperature rise with time per electric energy (W) is illustrated in FIG. 10. From the obtained result, it has been confirmed that the increased temperature reaches 1000° C.

REFERENCE SIGNS LIST

1 vessel
1*a* inside insulation part
1*b* heat conductive material
1*c* outside insulation part
2 counter electrode
2*a* first electrode
2*b* second electrode
3 heat-generating body
3*a* silicon powder
3*b* carbon powder
4 elastic body
4*a* first elastic body
4*b* second elastic body
5 incinerated ash
100 housing vessel
200 storing vessel
201 introduction port
202 exhaust port

The invention claimed is:

1. A heat-generating device comprising:
a hollow vessel having an electrically insulated inner surface;
a pair of counter electrodes housed inside the vessel, and separated from and opposing each other;
a heat-generating body housed between the counter electrodes inside the vessel, and comprising silicon powder and carbon powder in a mixed state; and
an elastic body between the electrically insulated inner surface and sides of the counter electrodes facing the electrically insulated inner surface.

2. The heat-generating device according to claim 1, wherein
the vessel is formed from a heat conductive material having at least an inner part subjected to electrically insulating treatment.

3. The heat-generating device according to claim 1, wherein
the vessel is composed of an elastic body.

4. The heat-generating device according to claim 1, wherein
the silicon powder and the carbon powder each have a particle diameter of 5 to 150 μm.

5. The heat-generating device according to claim 1, wherein
the heat-generating body contains incinerated ash.

6. The heat-generating device according to claim 2, wherein
the vessel is composed of an elastic body.

7. The heat-generating device according to claim 2, wherein
the silicon powder and the carbon powder each have a particle diameter of 5 to 150 μm.

8. The heat-generating device according to claim 3, wherein
the silicon powder and the carbon powder each have a particle diameter of 5 to 150 μm.

9. The heat-generating device according to claim 2, wherein
the heat-generating body contains incinerated ash.

10. The heat-generating device according to claim 3, wherein
the heat-generating body contains incinerated ash.

11. The heat-generating device according to claim 4, wherein
the heat-generating body contains incinerated ash.

12. The heat-generating device of claim 1, wherein the electrically insulated inner surface results from an alumite treatment.

13. The heat-generating device of claim 1, wherein the hollow vessel comprises aluminum; and wherein the electrically insulated inner surface has been subjected to an alumite treatment.

14. The heat-generating device of claim 1, wherein the heat-generating body further comprises fly ash.

15. The heat-generating device of claim 1, wherein the elastic body comprises a heat-resisting rubber.

16. A method for producing a heat-generating device, the heat-generating device being the heat-generating device according to claim 1, the method comprising the step of
mixing the silicon powder and the carbon powder to obtain the heat-generating body.

17. The method for producing a heat-generating device according to claim 7, wherein
the silicon powder and the carbon powder are mixed by agitation and/or vibration.

18. The method for producing a heat-generating device according to claim 7, wherein
a heating value of the heat-generating body is controlled on the basis of particle sizes, particle diameters, and/or a compounding ratio of the silicon powder and the carbon powder.

19. A method for producing a heat-generating device, the heat-generating device being the heat-generating device according to claim 2, the method comprising the step of
mixing the silicon powder and the carbon powder to obtain the heat-generating body.

20. A method for producing a heat-generating device, the heat-generating device being the heat-generating device according to claim 3, the method comprising the step of
mixing the silicon powder and the carbon powder to obtain the heat-generating body.

21. A method for producing a heat-generating device, the heat-generating device being the heat-generating device according to claim 4, the method comprising the step of
mixing the silicon powder and the carbon powder to obtain the heat-generating body.

22. A method for producing a heat-generating device, the heat-generating device being the heat-generating device according to claim 5, the method comprising the step of
mixing the silicon powder and the carbon powder to obtain the heat-generating body.

23. The method for producing a heat-generating device according to claim 17, wherein
a heating value of the heat-generating body is controlled on the basis of particle sizes, particle diameters, and/or a compounding ratio of the silicon powder and the carbon powder.

* * * * *